United States Patent [19]

Davis et al.

[11] Patent Number: 4,466,689

[45] Date of Patent: Aug. 21, 1984

[54] METHODS OF MAKING A TERMINAL AND PRODUCTS PRODUCED THEREBY

[75] Inventors: Dean I. Davis; Lyndon D. Ensz, both of Omaha, Nebr.; Matthew J. Grubelich, North Plainfield, N.J.

[73] Assignees: AT&T Technologies, Inc., New York, N.Y.; AT&T Bell Laboratories, Murray Hill, N.J.

[21] Appl. No.: 364,279

[22] Filed: Apr. 2, 1982

[51] Int. Cl.[3] ..... H01R 43/02; H01R 4/30

[52] U.S. Cl. ..... 339/263 R; 29/679; 29/882; 29/874; 339/276 SF

[58] Field of Search ..... 29/874, 882, 739, 564.1, 29/759; 10/152 T; 72/368, 370, 398; 339/258 R, 276 SF, 263 R

[56] References Cited

U.S. PATENT DOCUMENTS

| | | | |
|---|---|---|---|
| 2,675,774 | 4/1954 | Bergan | 72/368 X |
| 2,681,668 | 6/1954 | Lubbert | 29/759 X |
| 2,836,138 | 5/1958 | Matthysse et al. | 72/368 |
| 2,861,324 | 11/1958 | Klumpp, Jr. | 29/882 |
| 2,995,617 | 8/1961 | Maximoff et al. | 29/874 X |
| 3,434,102 | 3/1969 | Stancil | 29/874 X |
| 3,665,600 | 5/1972 | Hall . | |
| 3,777,303 | 12/1973 | McDonough . | |
| 3,858,153 | 12/1974 | Coller et al. . | |
| 4,253,234 | 3/1981 | Niles et al. | 29/882 |
| 4,266,310 | 5/1981 | Perrault et al. . | |

OTHER PUBLICATIONS

Conf. on Lasers and Electrooptics, Tech. Digest, Jun. 10–12, 1981, (Held in Wash., DC.).

Proc. of Soc. Photo-Optical Instrument Eng.'s, vol. 229, Apr. 7, 1980, (Wash., D.C.), p. 150.

*Primary Examiner*—Howard N. Goldberg
*Assistant Examiner*—Carl J. Arbes
*Attorney, Agent, or Firm*—Don P. Bush; E. W. Somers

[57] ABSTRACT

A terminal arrangement for interconnecting electrical conductors includes a plastic block (121) in which are supported a plurality of terminals (20—20) arranged in rows and columns. Each terminal is formed from a flat strip (81) of metallic material as the strip is advanced through a progressive punch and die apparatus. The terminal includes a first portion 21 which has a seam 33 that is welded to join butted longitudinal edges of that portion after it has been formed into a cylindrical shape from a flat blank on the strip. After its seam has been welded, the first portion is internally threaded to receive a terminal screw. A second portion 51 of the terminal, which is formed integrally with the first portion, has a generally square cross-section. The second portion of each terminal is disposed in a similarly configured cavity (127) of the plastic block to prevent relative rotational movement between the terminal and the block. Also, the second portion is seamed longitudinally by shear keys which resist axial forces that are imparted to the terminal during installation and use. A conductor-connecting portion, such as a wire wrapping tang, extends from the second portion to receive a conductor of a feeder or distribution cable, for example. Conductors are connected to terminals by terminal screws to connect selected conductors of a feeder cable to selected conductors of a distribution cable.

13 Claims, 18 Drawing Figures

METHODS OF MAKING A TERMINAL AND PRODUCTS PRODUCED THEREBY

TECHNICAL FIELD

This invention relates to methods of making a terminal and to products produced thereby. More particularly, it relates to a binding post terminal which is made from flat strip material and which is particularly useful for interconnection of feeder and distribution cables in outside telephone plant.

BACKGROUND OF THE INVENTION

In outside telephone plant, facilities must be provided for interconnecting feeder and distribution cables. Feeder cables extend from central offices to distribution areas where they are connected to distribution cables. The distribution cables are run to high density areas such as office buildings, for example, or to subdivisions where they are connected to service cables that extend to customers' premises.

A serving area interface is used to establish electrical connections between the feeder cables and the distribution cables. Typically, the interface is housed in a cabinet which is positioned in a location where it is safe from damage by vehicular traffic and flooding, where it is acceptable to property owners, and where it is not hazardous to employees and the public.

The connections are made through terminals which are mounted in rows and in columns in plastic terminal blocks that are supported in the cabinet. Feeder and distribution cables are brought into the cabinet and connected to the terminals. The terminals may be quick-connect type arrangements such as a bifurcated beam shown in U.S. Pat. No. 3,611,264 which issued on Oct. 5, 1971 in the names of B. C. Ellis et al. An earlier design terminal which is enjoying revived interest because of its excellent reliability is a binding post terminal.

In one prior art binding post arrangement, a terminal is made of rod material which is drilled and tapped at one end to form a barrel portion. A terminal screw, which comprises a threaded member having a head and two captive washers at one end, is turned into the barrel portion. From the other end of the terminal extends a wire wrapping portion. Conductors of a wiring harness are connected to selected wire wrapping portions after which the back side of each terminal block is encapsulated with a protective compound.

Conductors of the feeder and distribution cables are spliced to the conductors of the wiring harness. Field connections are made by crossconnecting jumpers between appropriate terminals that are connected to the conductors of the distribution cables and terminals that are connected to the conductors of the feeder cables. A field connection to a terminal is made by positioning a bared end of an insulated conductor between the two washers and wrapping the conductor about the terminal screw adjacent to its headed end. Then the screw is turned into the terminal to secure the conductor between the headed end and the terminal.

The manufacture of the terminal itself has been costly. Conventionally, it is necessary either to machine the entire part or to stamp a portion of it and weld on a separately machined threaded element. The machining has been accomplished by cold heading and tapping a blank having a barrel formed thereon. The wire-wrapping portion has been formed by coining and trimming one end portion of the blank.

Efforts have been made to produce internally threaded parts such as these terminals in other ways. For example, blanks have been engaged with a die having a threaded contour after which the blanks are formed into a cylindrical shape.

In U.S. Pat. No. 4,266,310, grooves are formed in a blank which is destined to become a terminal through opposed rectilinear motion between a punch and a die. The opposite edges of the grooved portions of the blank are brought together and the blank is given a cylindrical shape having an unjoined longitudinal seam. This, of course, requires precision forming of the blank in order to assure a match up of the grooves to form the internally threaded portion of the terminal. Inasmuch as the seam is not joined, axial forces could cause displacement of adjacent thread grooves and may prevent turning of the terminal screw into the barrel. On the other hand, to weld the seam would require that the thread grooves be aligned perfectly before the welding.

These efforts have not been altogether successful in producing a terminal having an accurately shaped thread. Consequently, traditional machining techniques have remained predominant in the terminal forming art.

Problems have also been encountered in the mounting of the terminals in the plastic blocks. In the past, the terminals have extended above the plastic terminal block. To prevent shorting between adjacent terminals during interconnection, the terminal barrels have been coated with an epoxy insulating material. Needless to say, this increases the cost of this terminal block arrangement.

Another problem that concerns the mounting of the terminals in the plastic block has surfaced. Barbs formed on and protruding from the terminal are wedged into the plastic as the terminal is inserted into an opening in the block. Stresses which are induced during the insertion of such a terminal become residual. When connections are made to the terminal block, additional stresses are imparted to the plastic. In some instances, the combination of stresses has been sufficient to cause a cracking of the plastic block.

What is needed and what is not shown in the prior art are methods of making a terminal which has an internally threaded portion and which is relatively low in cost. The terminal must be one which has a quality threaded portion to minimize the time required of installers to turn a terminal screw into the terminal barrel. Also, the terminals and their mounting block arrangement desirably should be such that electrical shorting between adjacent terminals and residual stressing of the plastic block are avoided.

SUMMARY OF THE INVENTION

The foregoing problems have been overcome by a terminal which is made in accordance with the methods of this invention. In a method of this invention, a flat strip of metallic material is advanced through a progressive punch and die forming apparatus. At successive work stations, the strip is formed to include a center portion with flat blanks depending from the center portion and staggered on opposite sides thereof. Each blank is connected to the center portion through a neck. Portions of each blank are rolled and formed into a terminal comprising a wall which has a substantially cylindrical configuration. The wall includes inner and outer surfaces and includes adjacent edge surfaces which form a butt seam. The adjacent edge surfaces are joined to form a sealed seam after which a screw thread is formed on the inner surface of the wall. The thread extends substantially uninterruptedly across the sealed seam. In a preferred embodiment, the thread is formed such that the distance from a crest of the thread to the outer surface of the wall is greater than the thickness of the strip. Also, in a preferred embodiment the terminal is separated from the strip after forming.

In a preferred embodiment of the methods of this invention, each blank is formed at successive stations to include a first portion having parallel, slightly upturned side edges. Side edges of a second portion are formed to include alternating tabs and cutouts with tabs on one side opposing cutouts on the other side. Then each blank is formed into a tube with the first portion, farthest from the center of the strip, having a cylindrical cross-section and the second portion with the tabs and cutouts being formed into a generally square cross-section. The opposed tabs and cutouts become interlocked to form shear keys and the abutting edges of the cylindrical portion are welded together. The center portion opposite each barrel is further formed to provide an extension for the aligned neck. At a subsequent station, the extension is joined to the neck of each blank to provide a conductor-connecting tang or bifurcated beam having a conductor-receiving slot. Subsequently, the cylindrical portion of each terminal is threaded internally. The interlocking keys of the second portion prevent axial shifting of opposing wall portions of the terminal along the seam and enhance the strength of the weld.

A terminal block which is made in accordance with the methods of this invention includes a base having a plurality of cavities each of which has a cross-section which matches that of the second portion of the terminal. The block also includes a plurality of pedestal sockets each having a circular cross-sectional opening therethrough and each being associated and aligned with a cavity. A terminal is disposed in each socket with at least a portion of its second portion being received in the aligned matching cavity of the base. This arrangement provides the capability of preventing relative rotational movement between the terminal and the block caused by torsional forces imparted to the terminal when a terminal screw is turned into the first portion. A conductor-connecting portion extends from each terminal through a slot that is formed in the base, and that communicates with the cavity in which the terminal is mounted.

BRIEF DESCRIPTION OF THE DRAWINGS

Other features of the present invention will be more readily understood from the following detailed description of specific embodiments thereof when read in conjunction with accompanying drawngs, in which.

DETAILED DESCRIPTION

Figure 1:
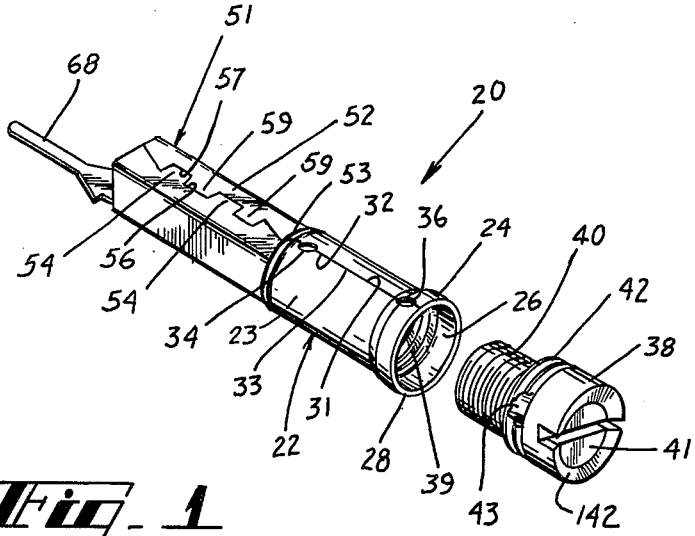
FIG. 1 is a perspective view of one of the terminals of this invention.
Figure 2A:
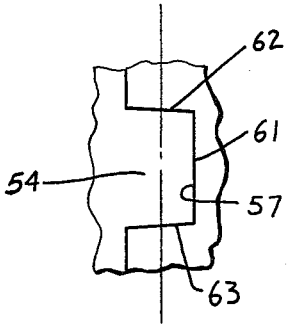
FIG. 2A is a detail view of a portion of the terminal.
Figure 2:
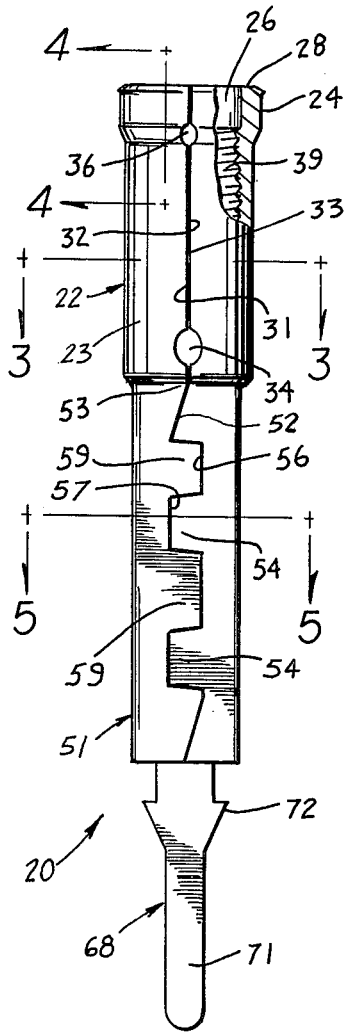
FIG. 2 is an elevational view of the terminal of FIG. 1.

Referring now to FIGS. 1 and 2, there is shown a terminal 20 of this invention. The terminal 20 is made from flat strip stock of a copper-nickel-tin alloy having a minimum tensile strength of about 75,000 psi and a Rockwell hardness of B85 maximum. The thickness of the strip is about 0.08 cm.

The terminal 20 comprises a first portion, designated generally by the numeral 22, sometimes called a barrel, which includes a wall 23 having a substantially cylindrical configuration and being about 1.2 cm in length. An end portion 24 of the first portion 22 is formed with a counterbore 26. An outer edge surface 28 of the end portion 24 is beveled at an angle of about 45° to avoid the nicking of conductors which are terminated by the terminals 20—20 of this invention in high density wiring arrangements.

Inasmuch as the terminal 20 is made from flat strip stock, edge surface portions 31 and 32 of the first portion 22 are butted together as the terminal is formed by turning portions of a blank. For added strength and for retention of thread continuity, the butted edge portions 31 and 32 which form a butt seam 33 are joined together such as by welding (see FIG. 3). As is seen in FIG. 1, holes 34 and 36 are formed in the portion 22 adjacent to ends of the butted edge surfaces. These holes provide stress relief for the welded seam. But for these, the welded seam 33 of the terminal could break apart when the terminal is torqued in a connection mode.

Figure 3:
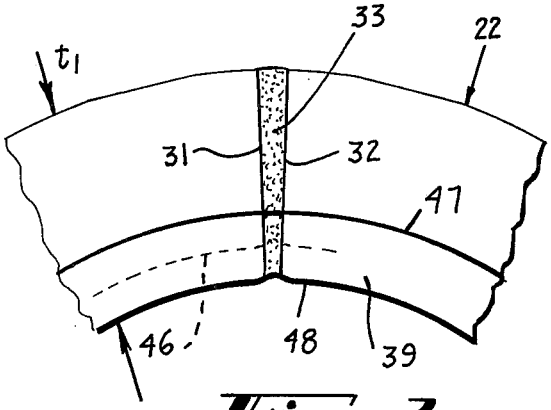
FIG. 3 is a cross-sectinal view of a wall of a first portion of the terminal of FIG. 2 taken along lines 3—3.
Figure 4:
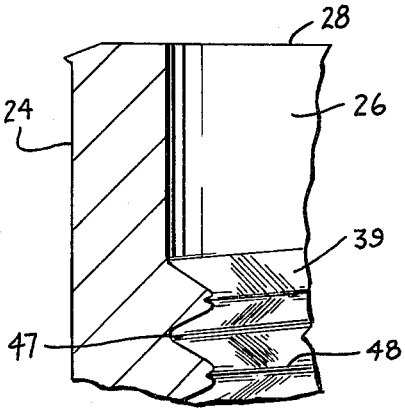
FIG. 4 is a cross-sectional view of a portion of the terminal of FIG. 2 taken along lines 4—4 thereof.

In order to hold securely a terminal screw 38 (see FIG. 1), the terminal 20 is provided with a screw thread 39 formed internally of the portion 22 (see also FIGS. 3 and 4). The threads 39—39 extend substantially uninterruptedly across the welded seam 33 and are adapted to have a threaded portion 40 of a terminal screw turned thereinto. This is unlike at least one prior art arrangement wherein the seam is not welded and the threads are formed before turning the blank into a cylindrical shape. If such a terminal were to be welded after being formed into a cylindrical shape, the weld bead most likely would protrude into the roots or grooves of the already formed threads and impede the turning of terminal screws.

The internally threaded portion 22 allows the terminal screw 38 to be turned into the terminal 20 to capture a conductor (not shown) under a head 41 of the screw between two captive, solder-plated washers 42—42. The washers 42—42 are disposed about an upper portion 43 of the terminal screw 38 which is unthreaded and is received in the counterbore 26 of the terminal 20.

Also of importance is the method of forming the threads 39—39 in the preferred embodiment. Instead of using a tap having cutting edges, a craftsperson uses a tap having lobes thereon. This process of forming the threads is called roll-threading in which the lobes displace metallic material to form the thread instead of cutting chips. Only a portion of the depth of the thread extends into the thickness of the original wall 23. Advantageously, a thinner wall section can be used than if the threads were cut with the entire depth of the thread being taken up by the wall.

As indicated hereinabove, the screw threads 39—39 extend substantially uninterruptedly across the seam 33. Moreover, some of the weld material at the seam is used to form the screw threads. This occurs because the welded seam extends through a pitch line 46 which eventually becomes the midpoint between a root or groove 47 and a crest or ridge 48 of the threads (see FIG. 3).

As can be seen in FIG. 4, the crest 48 of the thread 39 does not have exactly the same single peak configuration as that of a cut thread. Instead, there appears to be two peaks spaced apart by a depression which is caused by the method of forming the thread. The distance from the pitch line 46 of the thread to the crest 48 is slightly less than if the thread 39 had been cut. This slight variation from a cut thread, which is not caused by the forming of the thread through the welded joint, does not impede the turning of a screw 38 into the terminal. The root 47 of the thread 39 is essentially the same as that for a cut thread.

Because the screw threads in the first portion 22 are roll-formed, the crest diameter of the threaded portion of the first portion is less than the inner diameter of the originally unthreaded shape. Of course, if the threads were cut instead of being roll formed, the crest diameter of the threads of the first portion 22 would equal the inner diameter of the first portion before the threading operation.

Figure 5:
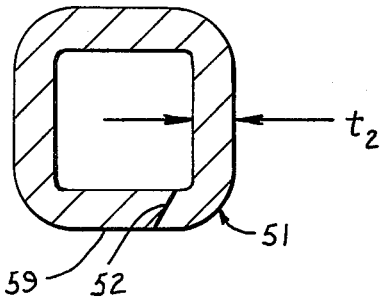
FIG. 5 is a cross-sectional view of a second portion of the terminal taken along lines 5—5 thereof.

Connected to the first portion 22 of the terminal 20 is a second portion, designated generally by the numeral 51 (see FIGS. 1 and 2). Unlike the first portion, the second portion 51 has a generally square cross-section (see FIG. 5) and is about 1.5 cm in length. A length of the second portion 51 is adapted to be received in a terminal-receiving cavity in a terminal block with the cavity having a cross-section which matches that of the second portion. This arrangement allows the terminal 20 to resist torque which is imparted to the terminal during connection steps and thereby prevents relative rotational movement between the terminal and a block in which it is mounted.

Although a square cross-section for the second portion 22 has been found to be preferable from the standpoint of forming, other configurations may also be suitable. For example a figure eight cross-section, or an oblong one may also be used. These of course would be more expensive to form, but the lock-in of the figure eight section into surrounding plastic would be particularly reliable for resisting torque loading.

The wall thickness $t_2$, of the second portion 51 is equal to the thickness of the strip from which the terminals 20—20 are made and is less than the thickness $t_1$, between the crest 48 of the thread of the first portion 22 and the outer surface notwithstanding the unitary nature of the first and second portions. This is due to the method of forming the screw thread 39.

As is seen in FIGS. 1 and 2, a seam 52 formed by edge surfaces of the terminal which are brought together continue from a lower end 53 of the seam 33 throughout the length of the second portion 51. However, the edge surfaces along the second portion 51 are serrated with tabs 54 and openings 56 along one edge surface opposed by openings 57 and tabs 59, respectively, along the other opposing edge surface. When the edge surfaces are brought together to form the second portion 51, the tabs and openings mesh together to form an interdigitated seam. The tabs 54 of one edge surface are received in the openings 57 of the other edge surface, and the tabs 59 are received in the openings 56.

Each of the openings 56—56 and 57—57 along the edge surfaces of the second portion 51 is formed to facilitate the keying together of the two edges. Each opening comprises a rear edge 61 (see FIG. 2A) and two entry surfaces 62 and 63. The entry surfaces 62 and 63 are formed at an angle to the rear edge which exceeds 90°. In this way, the tabs 54 and 59 can be inserted into the openings 57 and 56 without the occurence of any binding.

The tab and opening arrangement is effective to provide shear keys to resist separation forces which are imparted to the seam of the terminal 20. For example, when the terminals 20—20 are inserted into plastic terminal blocks, axial forces must be applied to the terminals. However, these forces are negligible as compared to lateral separation forces which are generated as a result of torquing a terminal screw 38 into a terminal 20. The stresses imparted to the terminal 20 by this action are so severe that but for the shear keys, or an equivalent arrangement, the weld along the seam 33 of the portion 22 could be broken.

It will be observed from the drawings, particularly FIG. 2 thereof, that the seams of the first and second portions are aligned. The shear key formed in the second portion 22 could be eliminated by increasing the length of the welded seam. For example, in the preferred embodiment, the length of weld in the first portion is about 0.76 cm. If this were to be extended to about 1.3 cm, the shear keys in the second portion would be unnecessary for the terminal to resist specific torquing loads. Then the seam along the second portion 51 would be colinear with that of the first portion. Of course, if the torquing load requirement were to be reduced, an unjoined butted seam could be used along the second portion 51 with no increase in the 0.76 cm weld length being required.

A lower edge 66 of the second portion 51 is beveled. This facilitates insertion of the terminal 20 into a plastic terminal block and avoids any nicking or gouging of the plastic material.

Although the preferred embodiment of the terminal made in accordance with the methods of this invention includes a second portion 51, a terminal having only the first portion would be within the scope of this invention. In that instance, the torque could be resisted by forming a portion of the barrel 22 to receive a protruding key in a terminal-receiving cavity of a plastic block.

Figure 6:
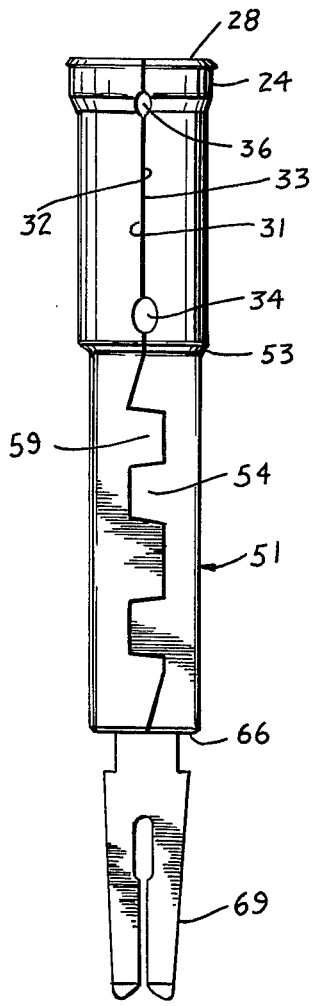
FIG. 6 is an elevational view of an alternative embodiment of the terminal.

From a lower end 66 of the second portion 51 extends a conductor-connection portion 68 (see FIGS. 1 and 2) having a length of about 1.1 cm. The conductor-connection portion 68 may be a wire-wrapping tang such as is shown in FIGS. 1 and 2 or it may be a bifuracted beam connector 69 such as is shown in FIG. 6. A bufurcated beam connector having a conductor receiving slot is shown in U.S. Pat. No. 3,858,158, which issued on Dec. 31, 1974, in the names of R. W. Henn et al and which is incorporated by reference hereinto.

For the embodiment shown in FIGS. 1 and 2, the tang 68 includes a generally elongated portion 71 having a barb 72 in each side thereof. The portion 71 has a thickness of about 0.08 cm which is equal to that of a wall of the portion 51. In prior art terminals, the wire-wrapping portion was formed by coining a lower portion of rod stock from which the terminal was made. Because of the difference in thickness between the rod stock and the conductor-connecting portion, a number of forming operations would have been required to provide a bifurcated beam.

In a method of making the terminal 20 of this invention, a flat strip 81 of metallic material (see FIG. 7) is advanced through a progressive punch and die apparatus. Portions of the strip 81 are formed sequentially through successive reciprocal motions of punch and die combinations within the appartus. As is seen in the drawings, metal is removed from the strip 81 to form a center section 83 with blanks 85–85 extending laterally from the center section. Each blank 85 is connected to the center section 83 through a neck 87. The blanks 85—85 on opposite sides of the center section 83 are staggered along the strip 81.

Figure 7:
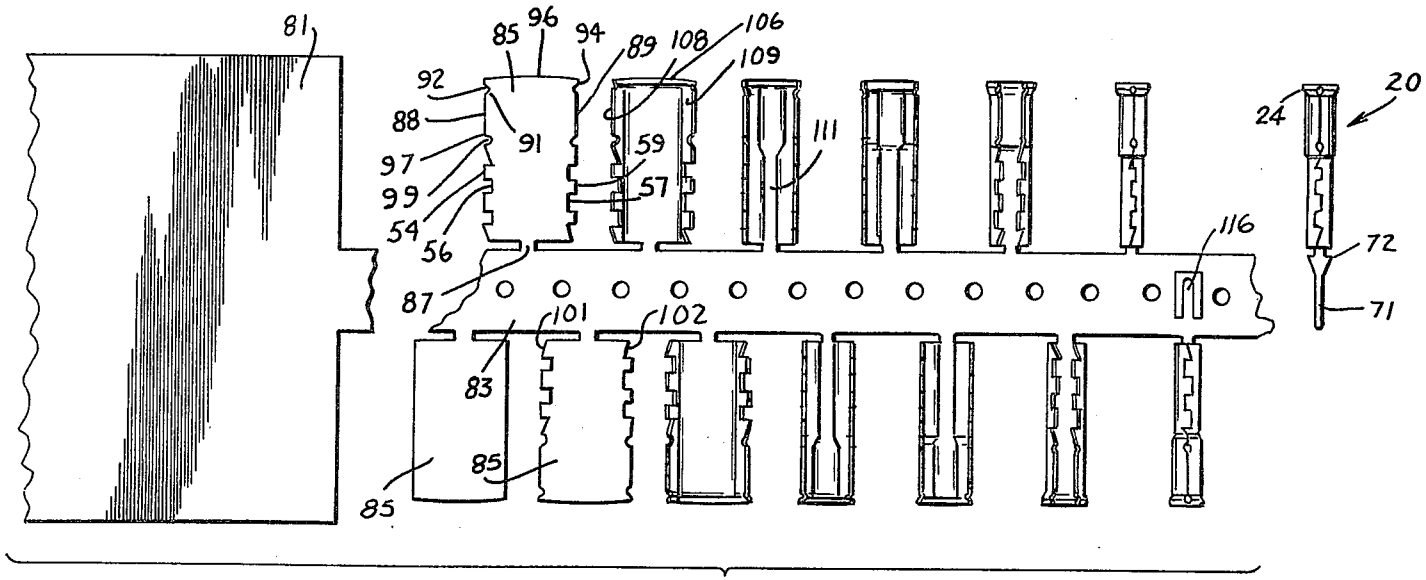
FIG. 7 is a plan view of a strip of terminals at various steps in a progressive punch and die apparatus.
Figure 8:
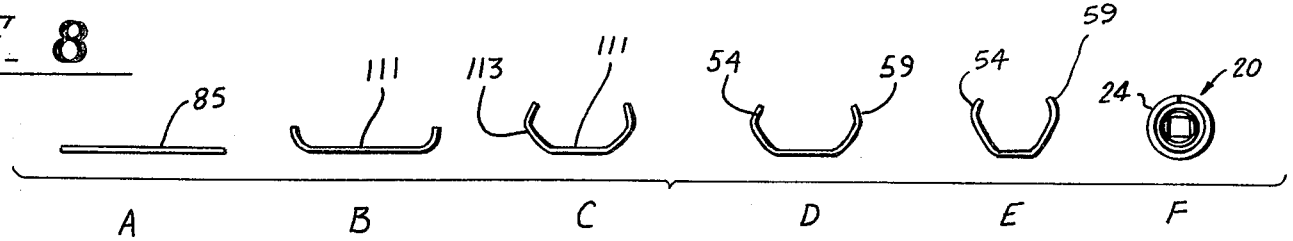
FIG. 8 is a side elevational view of the strip of terminals at various steps in its forming.

Each blank 85 is formed to include two substantially parallel side edge surfaces 88 and 89 along a portion of its length. An outer end 91 of each edge surface 88 and 89 connects with a slight indentation 92 from which extends an inclined edge 94 to an outer edge surface 95. From an inner end 97 of each of the substantially parallel side surfaces of the blank 85, there is formed another indentation 99. Moving toward the center portion 83 of the strip 81, it is seen that edge surfaces 101 and 102 are serrated with the alternating tabs 54 and 59 and openings 56 and 57 respectively. Moreover, the tabs along one edge surface are aligned with openings along the opposite edge surface of each blank 85. Following punch and die operations to bring the blanks 85—85 to this stage (as shown in FIG. 7 and FIG. 8A), the blanks are ready to be formed into the terminals 20—20.

At a next station, another portion 106 of the first section 22 is upset to displace it slightly out of the plane of the strip. Then side portions 108 and 109 of each blank 85 are turned about an axis extending longitudinally through the first and second portions 22 and 51 and the neck 87 of each blank 85. The turning of the side portions 108 and 109 of the portion 22 is accomplished to cause the formation of a curved configuration. On the other hand, the portion 51 is turned about a flat longitudinally extending center portion 111 (see FIG. 8B) that extends from the first portion 22 to the neck 87.

Further turning of the first portion 22 causes it to assume a substantially cylindrical configuration with the side edge surfaces 88 and 89 being butted together. It should be understood that a relatively slight gap may occur between portions of the opposing side edge surfaces after the first portion 22 has been formed into a substantially cylindrical configuration. When brought together, the indentations 92 and 99 at each end of each parallel side edge surface 88 and 89 form the relatively small openings 34 and 36 through the barrel formed by the turned blank 85. The outermost portion 106 of each blank 85 is formed into a counterbore to receive the unthreaded end 43 of a terminal screw 38.

The turning of the second portion 51 (see FIGS. 8D–8E) is accomplished to form a generally square cross-section. It should be observed that the width of the tabs 54 and 59 and openings 56 and 57 is about equal to the width of a side of the square cross-section portion 51. First, a longitudinal portion of each of the sides of the second portion 51 is upturned and angled outwardly from the plane of the strip 81 (see FIG. 8B). Then a portion 113 of the second portion 51 that has a width extending from the bottom portion 111, which remains in the plane of the strip 81, to the tabs 54 and 56 is turned upwardly and angled to the bottom portion (see FIG. 8C). This causes the portion which includes the tabs 54 and 59 to be directed slightly inwardly toward each other (see FIG. 8D). The edge surfaces of the second portion 51 are brought closer together (see FIG. 8E). Finally, the tabs 54 and 59 and openings 56 and 57 are interlocked to form the lower portion 51 into its square cross-section.

Subsequently, the butted portions 31 and 32 are joined together such as by laser welding in a preferred embodiment. Butted edge surface portions are melted and the material reflows together to form a sealed seam. Afterwardly, the portion 22 is threaded internally to form the screw threads 39—39. The threads are continuous and their profile substantially uninterrupted across the seam 33. In the preferred embodiments, portions of the wall of the portion 22 and of the weld material across the seam are displaced to form the roots and the crests of the threads.

After each terminal 20 has been formed, welded and threaded (see FIG. 8F), it is separated from the carrier strip 81. At separation, extensions 116—116 of the necks 87—87 (see FIG. 7) which have been formed in the strip are connected to the necks to form the wire-wrapping portions 71—71. It is within the scope of this invention to separate the roll-formed blanks 85—85 from the strip 81 and then to weld the seam 33 and thread internally the portion 22 of each.

Figure 9:
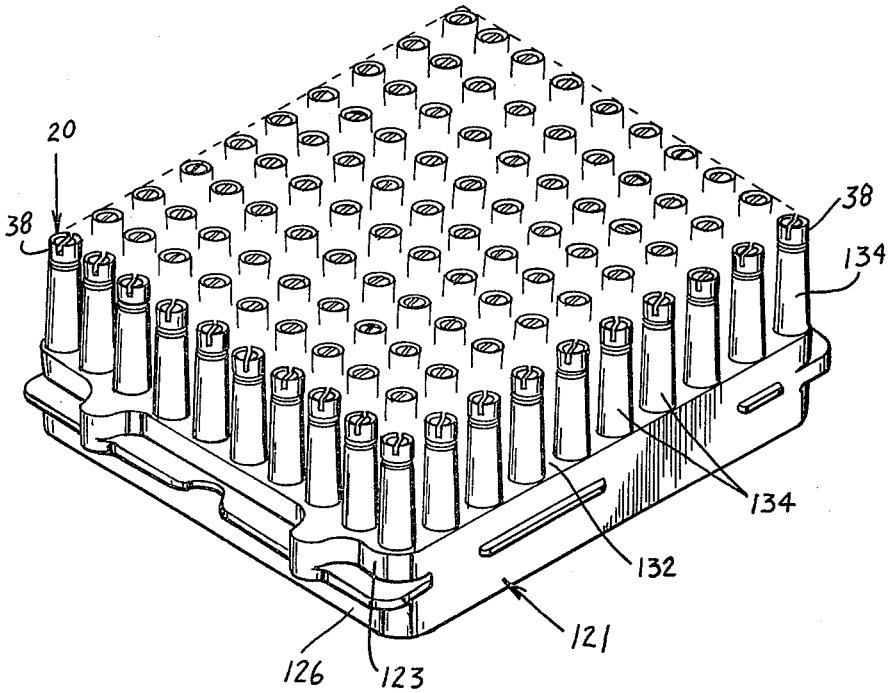
FIG. 9 is a perspective view of a terminal block of this invention in which a plurality of terminals are arranged in rows and columns.
Figure 10:
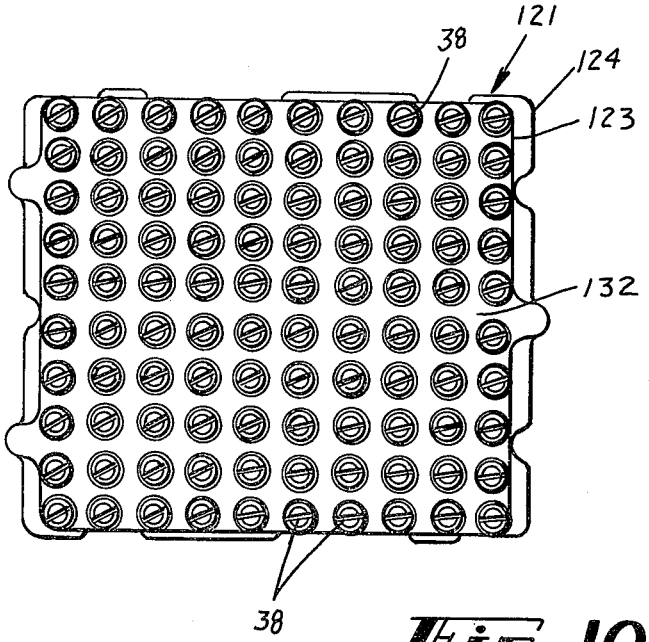
FIG. 10 is a plan view of the terminal block of FIG. 9.
Figure 11:
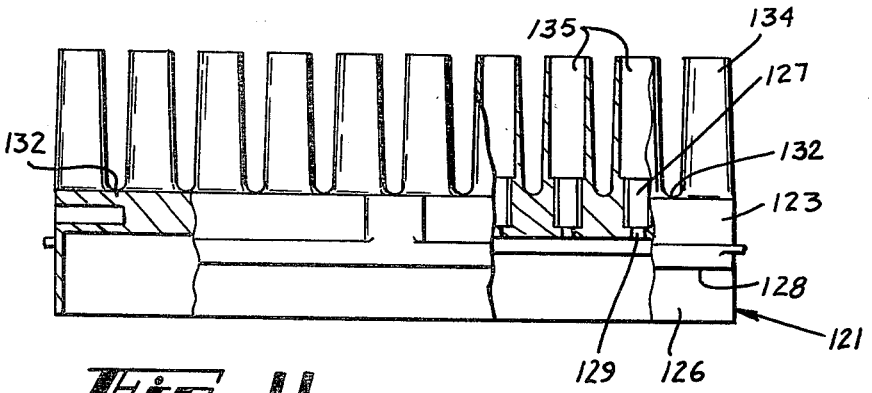
FIG. 11 is a side elevational view of the terminal block of FIG. 9 which is partially in section.

In FIGS. 9, 10 and 11 there is shown a block 121 for supporting a plurality of the terminals 20—20 in columns and rows. The block 121 is made of a plastic material such as a polycarbonate material which is marketed by the General Electric Company under the designation LEXAN® plastic.

Figure 13:
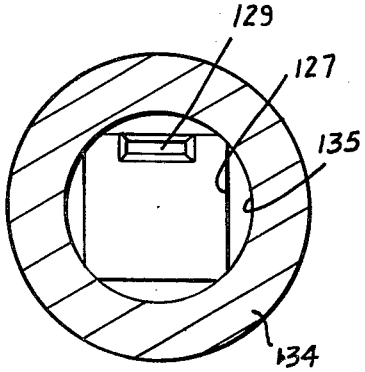
FIG. 13 is an enlarged plan view of a portion of the block of FIG. 12 and taken along lines 13—13.
Figure 14:
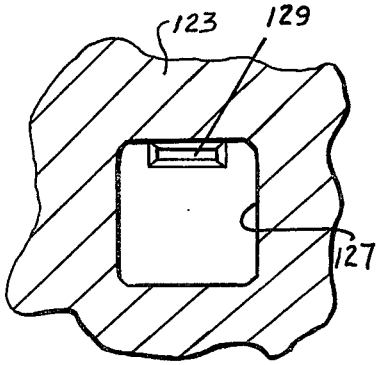
FIG. 14 is an enlarged plan view of a portion of the block of FIG. 12 and taken along lines 14—14.

The terminal block 121 includes a base 123 from which a peripheral rim 126 extends. The base 123 includes a plurality of counterbored cavities 127—127 (see also FIGS. 12–14) each of which has a generally square cross-section to match that of the second portion 51 of the terminal 20. The dimensions of the cavity 127 relative to the terminal 20 are such that the fit between the terminal and its cavity is not an interference one. This avoids the prior art problem of residual stresses in the terminal block. Each of the openings 127—127 communicates with an underside 128 of the base 123 through a slot 129. Between adjacent rows of cavities 127—127 and extending from the underside of the base 123 are two ribs 131–131.

Figure 12:
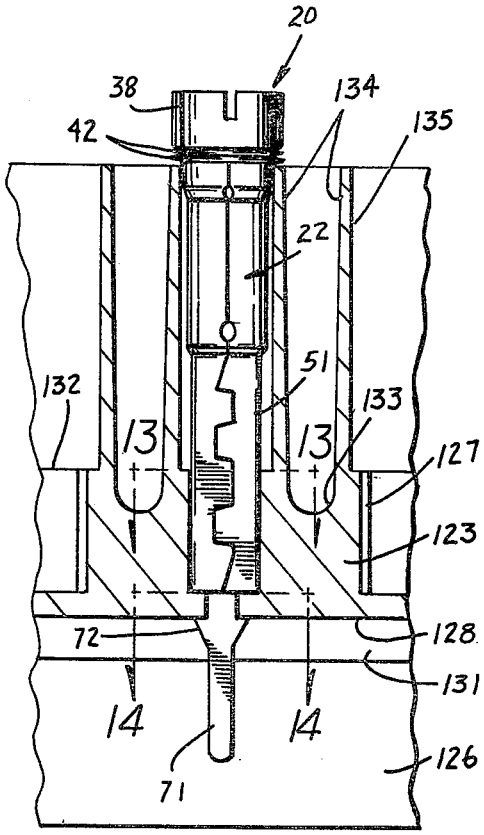
FIG. 12 is an enlarged view partially in section of a portion of the block of FIG. 9 with a terminal disposed in an aligned socket and cavity of the block.

A side 132 of the base 123 opposite to the underside 128 is formed with a plurality of pedestal type sockets 134–134 (see FIGS. 9, 11 and 12). Each socket 134 has a generally circular cross-sectional configuration, is molded integrally with the base, and includes a passageway 135 having a circular cross-section. The height of each pedestal 134 is greater in length than the length of the cylindrical first portion of the terminal. Accordingly, when a terminal 20 is mounted in a socket 134, a portion of its second portion 51 is disposed in the cavity 127 and a portion in the opening 135.

A terminal 20 is inserted into each of the sockets 134–134 of the block 121 (see FIGS. 9, 10, 12 and 15). When a terminal 20 is inserted into the block 121, its cylindrical first portion 22 and a portion of the square second portion 51 are received in the pedestal socket 134. Another portion of the second portion 51 is received in the aligned cavity 127 in the base 123 with the wire-wrapping tang 71 extending through the slot 129. Sufficient force must be applied to the terminal 20 to cause the side barbs 72—72 on the tang 71 to shear through the walls of the slot 129 to cause the terminal to be seated in the block 121 with the tang protruding past the ribs 131—131.

After the terminals 20—20 have been gang-inserted into the block 121, conductors of a harness (not shown) are connected to the depending portions 71—71 of the terminals. Then a potting compound such as polyurethane is applied to the underside of the base 123 with the peripheral rim 126 providing a mold for the compound.

As will be recalled, the terminal screw 38 includes the threaded portion 40 and the slotted head 41. The slotted head 41 has what is referred to as a quiet front in that it is enclosed laterally by an insulative material 142. In this way, an installer who uses a tool to wrap a conductor about a screw 38 cannot short out between exposed heads of adjacent terminals 20—20 which would cause noise on a customer line.

Figure 16:
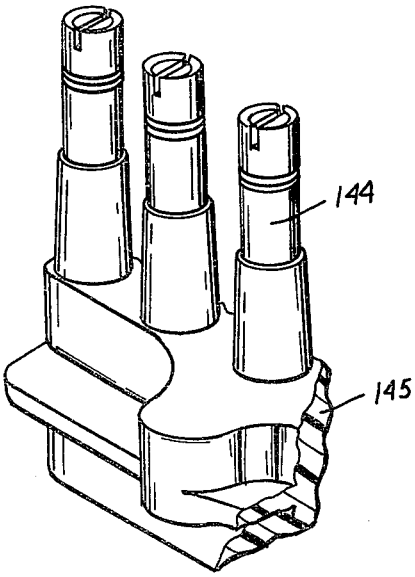
Fig. 16 PRIOR ART
FIG. 16 is a perspective view of a prior art terminal block arrangement.

Another advantage of the present system is derived from the use of the pedestal sockets 134—134. In the past, sockets of this height were not used. To prevent short out between adjacent terminals, each was coated with an epoxy material 144 (see FIG. 16) for a portion of its length that was exposed above a terminal block 145. The block 121 obviates the need for the epoxy coating thereby saving substantial costs.

Figure 17:
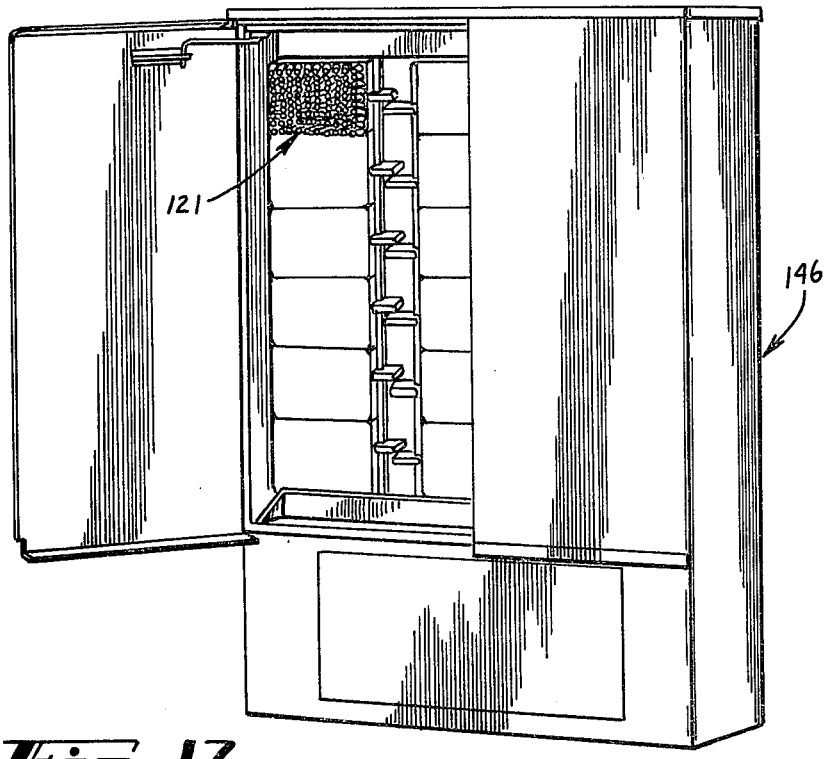
FIG. 17 is a perspective view of a cabinet for housing a plurality of the terminal blocks of FIG. 9.
Figure 15:
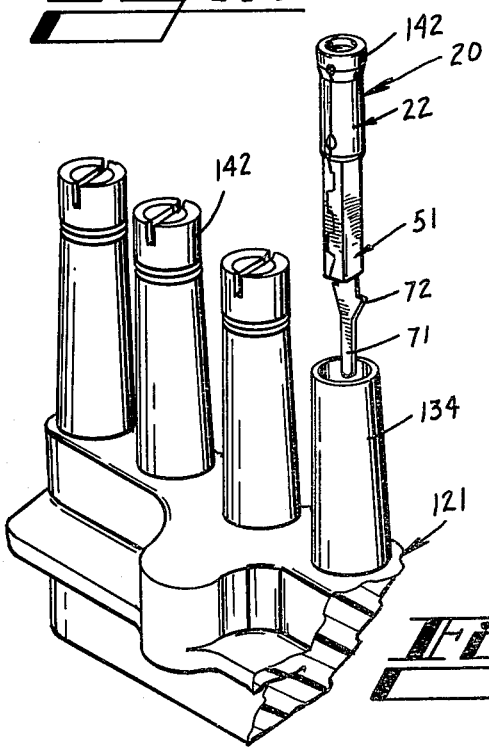
FIG. 15 is a perspective view of a portion of the terminal block of FIG. 9 with one of the terminals of this invention withdrawn from its socket.

A plurality of the blocks 121—121 are mounted in a cabinet 146 (see FIG. 17). In the field, distribution and feeder cables (not shown) are brought into the cabinet and connected to conductors of the harnesses that have been preconnected to the conductor-connecting portions 68—68 of the terminals. Installers then cross-connect jumpers between terminals connected to the feeder cables with those of the distribution cables to provide suitable customer connections. These are made by wrapping one bared end portion of a conductor about a terminal screw 38 which has been turned into a terminal 20 in a socket 134 and the other bared end portion about another preselected terminal screw.

It is understood that the above-described arrangements are simply illustrative of the invention. Other arrangements may be devised by those skilled in the art which will embody the principles of the invention and fall within the spirit and scope thereof.

What is claimed is:

1. A method of making a terminal, said method comprising the steps of advancing a flat strip of metallic material;

removing material from the strip to form spaced blanks;

bending portions of each blank to cause the blank to be formed into a terminal comprising a wall having a substantially cylindrical configuration with inner and outer surfaces and with opposing edge surfaces of the blank being disposed to each other to form a butt seam in the wall;

joining the adjacent edge surfaces of the wall to form a sealed seam; and then forming a screw thead on the inner surface of the wall and across the sealed seam.

2. A method of making a terminal which is capable of having a terminal screw turned thereinto, said method including the steps of:

advancing a flat strip of metallic material through a plurality of work stations;

removing material from a side of said strip to form spaced generally rectangular blank portions each of which is connected to the strip through a neck;

forming each blank into a terminal by bending side portions to cause a first portion of the blank to be formed into a wall having a substantially circular configuration with inner and outer surfaces and with opposing edge surfaces of the blank being adjacent to each other and forming a butt seam in the wall, and to cause a second portion of the blank to be formed into a configuration which is adapted to cooperate with surrounding plastic material of a block in which the terminal is adapted to be mounted for preventing relative rotational movement between the terminal and the block;

joining the adjacent edge surfaces of the wall of the first portion to form a sealed seam; then forming a screw thread on the inner surface of the wall of the first portion with a root and a crest of the thread extending substantially uninterruptedly across the joined seam; and separating the terminals from the strip.

3. The method of claim 2, wherein said step of forming each blank into a terminal includes the step of causing the second portion to have a substantialy square cross-section.

4. The method of claim 3, wherein the second portion has a seam aligned with the seam of the first portion, and which also includes the step of serrating edge surface portions of the second portion which forms its seam and said step of forming by bending causes opposing serrated edge portions to be meshed together to form an interdigitated seam that extends generally from the seam of the first portion.

5. The method of claim 2, wherein the forming of the screw thread on the inner surface of the wall of the first portion is accomplished in a manner which causes portions of the wall to be displaced to form the thread, and wherein the thickness of the threaded wall from a crest of the thread to the outer surface of the wall of the first portion is greater than the thickness of the strip.

6. The method of claim 2, wherein each of the side portions of the blank which are formed into the substantially cylindrical configuration includes an indentation at each end thereof such that when the edge surfaces are butted to form a seam, the opposed indentations form an opening through the wall of the first portion at each end of the seam.

7. A terminal which is made in accordance with the method of claim 2.

8. A terminal which is made in accordance with the method of claim 3.

9. A terminal which is made in accordance with the method of claim 4.

10. A terminal which is made from a metallic strip material in accordance with the method of claim 2 wherein the second portion is integral with said first portion and has edge portions that cooperate to form a seam that is sufficient to maintain the sealed seam of the first portion during the turning of a terminal screw into the first portion when the terminal is mounted in a terminal block.

11. A method of making a terminal block for making connections between conductors, said method including the steps of:

making a plurality of terminals each of which is adapted to have conductors connected thereto, said making including the steps of:

advancing a strip of metallic material through a plurality of work stations;

removing material from a side of the strip to form spaced, generally rectangular blank portions, each of which is connected to the strip;

forming each blank into a terminal by bending side portions to cause opposing side edge portion of the blank to be adjacent to each other to form a butt seam and to cause the first portion of each blank to be formed into a wall having a substantially cylindrical configuration and having inner and outer surfaces, and to cause a second portion of the blank to be formed into a predetermined configuration;

joining the adjacent edge surfaces of the wall of the first portion to form a sealed seam;

forming a screw thread on the inner surface of the wall of the first portion with a root and crest of the thread extending substantially uninterruptedly across the sealed seam, the first portion adapted to have a terminal screw turned thereinto to secure a conductor to the terminal; and separating the terminals from the strip; and providing a block which is made of dielectric material and which includes a base having a plurality of cavities formed therein, each of the cavities having a cross-section substantially congruent to that of the second portion of the terminal, the block also including a plurality of sockets, each socket being associated and aligned with a cavity and extending from one side of the base, and each of the sockets having a generally circular cross-section opening extending therethrough and communicating with an associated aligned cavity in the base; and inserting a terminal into each of the sockets of the block with the first portion of each being disposed in the socket and with at least a portion of the second portion being received in the associated aligned cavity, the configuration of the second portion of each terminal cooperating with the cavity in which it is disposed to prevent relative rotational movement between the terminal and the block.

12. The method of claim 11, which also includes the steps of forming the base with a plurality of slots each of which communicates with one of the cavities positioned eccentrically of the longitudinal axis of the cavities, and wherein said method also includes the step of forming each terminal with a third portion which extends from the second portion and said step of inserting a terminal into each socket causes the third portion of each terminal to protrude through the slot and be adapted to have a conductor connected thereto.

13. The method of claim 11, wherein the step of forming a screw thread is accomplished such that each first portion of each terminal has an unthreaded portion adjacent to the opening of the socket in which it is received.

* * * * *